United States Patent [19]

Babendererde

[11] Patent Number: 4,629,255

[45] Date of Patent: Dec. 16, 1986

[54] TUNNELING MACHINE

[75] Inventor: Siegmund Babendererde, Bad Vilbel, Fed. Rep. of Germany

[73] Assignee: Hochtief Aktiengesellschaft vorm. Gebr. Helfmann, Essen, Fed. Rep. of Germany

[21] Appl. No.: 697,786

[22] Filed: Feb. 4, 1985

[30] Foreign Application Priority Data

Feb. 4, 1984 [DE] Fed. Rep. of Germany ..... 3403890

[51] Int. Cl.[4] ..... E21D 9/08; E21D 9/12

[52] U.S. Cl. ..... 299/33; 299/56; 299/64; 299/68

[58] Field of Search ..... 299/56, 64, 68, 33; 175/62; 198/614, 747

[56] References Cited

U.S. PATENT DOCUMENTS

| | | | |
|---|---|---|---|
| 2,540,670 | 2/1951 | Hoenecke | 198/747 |
| 3,042,229 | 7/1962 | Winter | 198/614 X |
| 3,260,548 | 7/1966 | Reichl | 299/64 |
| 3,334,945 | 8/1967 | Bartlett | 299/56 |
| 3,995,734 | 12/1976 | Berg, Jr. | 198/747 X |
| 4,082,368 | 4/1978 | Funk | 299/64 X |
| 4,165,129 | 8/1979 | Sugimoto et al. | 299/31 X |
| 4,406,220 | 9/1983 | Bergman | 198/747 X |
| 4,456,305 | 6/1984 | Yoshikawa | 299/56 X |

FOREIGN PATENT DOCUMENTS 2745215 4/1979 Fed. Rep. of Germany ..... 299/56

*Primary Examiner*—Stephen J. Novosad
*Assistant Examiner*—Michael A. Goodwin
*Attorney, Agent, or Firm*—Karl F. Ross; Herbert Dubno

[57] ABSTRACT

A tunneling apparatus has a lateral shield having a front end normally engaged longitudinally against a tunnel end face, a digging tool at the front end of the shield and engageable with the tunnel face, and a drive for displacing the tool and digging the tunnel face. A transverse pressure wall across the shield forms a pressurizable chamber inside the front end of the shield around the tool at the tunnel face. A conveyor tube longitudinally traverses and has a front end open ahead of the wall in the chamber and adapted to receive material freed from the tunnel face by the digging tool. An auger can be rotated in the tube to displace freed material back in it from its front end to its rear end. A chute opens upward into the rear end of the conveyor tube to receive material therefrom and a pump tube extends longitudinally back from the chute. A piston pump between the chute and the pump tube can displace material from the chute back in the tube.

4 Claims, 2 Drawing Figures

TUNNELING MACHINE

FIELD OF THE INVENTION

The present invention relates to an apparatus for driving a tunnel. More particularly this invention concerns such an apparatus which operates with overpressure at the face being tunneled.

BACKGROUND OF THE INVENTION

A standard tunneling apparatus has a lateral shield having a front end normally engaged longitudinally against a tunnel end face into which the tunnel is to be driven. A digging tool at the front end of the shield engages the tunnel face and is driven to dig the tunnel therein. In order to work with overpressure at the face being worked a transverse pressure wall extends across the shield and forms a pressurizable chamber inside the front end of the shield around the tool at the tunnel face. A conveyor tube longitudinally traverses this wall and has a front end open ahead of the wall and is adapted to receive material freed from the tunnel face by the digging tool. An auger in the tube is rotated to displace freed material back in the tube from the front end of the tube to the rear end thereof, which in turn is provided with a chute that receives material from the auger conveyor.

Such a machine is pushed longitudinally forward so the digging tool, which is typically a large toothed wheel, bites into the face, removing material therefrom that is conveyed back by the auger. The entire apparatus can inch forward as the face is cut away, the tunnel thus formed being concreted or lined behind the apparatus.

The overpressure at the face reduces the likelihood of cave in and holds back any ground water, in fact allowing the apparatus to tunnel through underground aquifers, under rivers, or in similarly wet surroundings. As a rule the overpressure is simply created by injecting a fluid—air, water, or a water/clay suspension—into the space within the front end of the shield in front of the transverse pressure wall. The auger conveyor is typically made of the sealing type with a very shallowly pitched auger so that the material it conveys effectively blocks the conveyor tube and prevents pressure loss back therethrough.

From the rear end of the conveyor tube the material freed by the digging tool drops through a chute onto another conveyor for transport longitudinally back out of the tunnel. A belt-type conveyor or a succession of wagons is typically used in this location behind the tunneling machine. Thus the area behind the apparatus is cluttered, making it difficult to seal the tunnel in this region. Thus either the sealing crew must work around the conveyor, the sealing work must be done relatively far behind the apparatus, or the apparatus must be shut down and the conveyor taken out of the way. All of these solutions are disadvantages.

OBJECTS OF THE INVENTION

It is therefore an object of the present invention to provide an improved tunneling machine.

Another object is the provision of such a tunneling machine which overcomes the above-given disadvantages, that is which does not use a bulky back conveyor so that the area immediately behind the machine is left relatively uncluttered.

SUMMARY OF THE INVENTION

A tunneling apparatus according to the invention has a lateral shield having a front end normally engaged longitudinally against a tunnel end face, a digging tool at the front end of the shield and engageable with the tunnel face, and a drive for displacing the tool and digging the tunnel face. A transverse pressure wall across the shield forms a pressurizable chamber inside the front end of the shield around the tool at the tunnel face. A conveyor tube longitudinally traverses and has a front end open ahead of the wall in the chamber and adapted to receive material freed from the tunnel face by the digging tool. An auger can be rotated in the tube to displace freed material back in it from its front end to its rear end. A chute opens upward into the rear end of the conveyor tube to receive material therefrom and a pump tube extends longitudinally back from the chute. A piston pump between the chute and the pump tube can displace material from the chute back in the tube.

The instant invention is based on the recognition that when driving a tunnel or shaft the material that is dug out can be transported relatively easily by a piston pump constructed along the lines of a heavy-duty concrete pump. The tube can be a flexible hose that will not hinder operations behind the machine.

According to a feature of this invention the piston pump comprises a pump cylinder having a side port connected to the chute and an end connected to the tube and a piston displaceable toward and away from the cylinder end past the side port. The piston completely blocks the side port when advanced to the cylinder end.

To assist the conveyance of the material back in the tube a conveyor fluid is admitted into the chute or pump cylinder. Thus this conveyor fluid pushes the material back in the tube.

An overflow or bypass valve may be provided when the conveyor is not of the sealing type. The digging tool is a toothed wheel and the chamber is pressurized with a fluid such as air or water.

DESCRIPTION OF THE DRAWING

The above and other features and advantages will become more readily apparent from the following, reference being made to the accompanying drawing in which.

SPECIFIC DESCRIPTION

Figure 1:
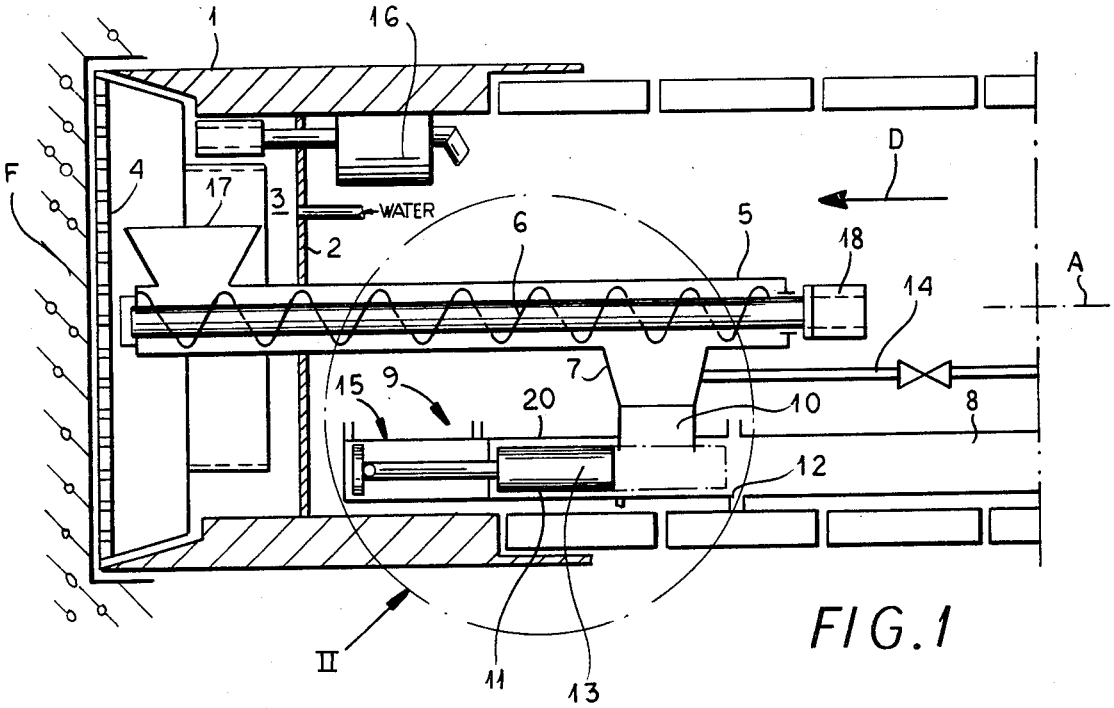
FIG. 1 is a partly diagrammatic axial and longitudinal section through the tunneling apparatus according to the invention.

As seen in the drawing, the apparatus of this invention is used to tunnel in a direction D into a face F. The apparatus has a cylindrical shield 1 centered on an axis A parallel to the direction D and closed by a transverse wall 2 to form a chamber 3 that can be pressurized by means of a supply of an appropriate fluid, for instance water. This chamber 3 contains a digging wheel 4 rotatable by a drive 16 about the axis A to cut into the face F and pull from it material that drops into an intake hopper 17 at the front end of a conveyor tube 5 that axially and longitudinally traverses the wall 2. An auger 6 inside this tube 5 is rotated by a drive 18 to move the material back from the intake 17 to an output chute 7 extending down from the rear end of the tube 5.

Figure 2:
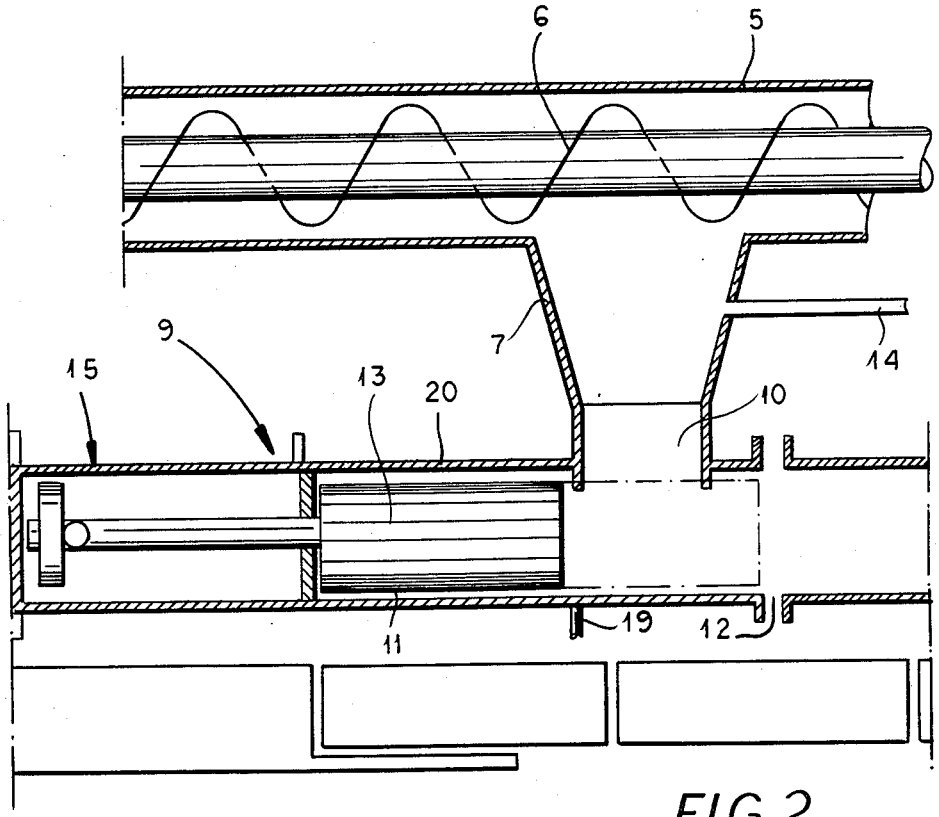
FIG. 2 is a large-scale view of the detail indicated generally at dot-dash circle II in FIG. 1.

A port 10 of a pump cylinder 20 in which a piston 13 is longitudinally reciprocal by a double-acting ram 15 is connected to the lower end of the chute 7. The piston 13 is shaped so that it completely blocks the port 10 when it is in the advanced back position shown in dot-dash lines in FIG. 2. Thus this piston can act like a valve closing this port 10.

The pump cylinder 20 is connected at a joint 12 to a flexible hose 8. An entrainment fluid such as air or water is introduced at 14 into the chute 7 to keep the material freed by the digger 4 fluent. A similar such supply 19 opens into the pump cylinder 20.

The arrangement can have another such pump 9 so that the two pumps can be operated alternately to ensure nearly continuous flow in the hose 8, in the manner of a concrete pump. Under any circumstances the material freed by the digger 4 is eminently suitable to such transport, so that the site behind the machine is only traversed by a relatively small conveyor hose 8, allowing a crew to work on sealing the tunnel immediately behind the machine while same is in operation. The safety of such operation is plain, as is the efficiency of being able to seal and drive the tunnel at the same time.

I claim:

1. A tunneling apparatus comprising:

a shield having a front end normally engaged horizontally in a longitudinal direction against a tunnel end face, the shield extending in the direction;

a digging tool at the front end of the shield and engageable longitudinally with the tunnel face;

drive means for displacing the tool and digging the tunnel face for forming a longitudinally extending tunnel;

a transverse pressure wall extending crosswise of the direction across the shield and forming a longitudinally forwardly open pressurizable chamber at the front end of the shield around the tool at the tunnel face;

means for pressurizing the chamber;

a conveyor tube longitudinally traversing the wall and having a front end open ahead of the wall in the chamber and adapted to receive material freed from the tunnel face by the digging tool and a rear end longitudinally behind the wall;

an auger in the tube;

drive means for rotating the auger and thereby displacing freed material back in the tube from its front end to its rear end;

a chute open upward into the rear end of the conveyor tube to receive material therefrom;

means including a conduit opening into the chute for admitting a conveyor fluid into the chute under pressure, whereby the conveyor fluid pushes the material back in the tube;

a pump tube extending longitudinally back from the chute;

a piston pump between the chute and the pump tube and comprising a pump cylinder having an upwardly open side port into which the chute opens downward and a longitudinally backwardly open end connected to the pump tube, and a piston displaceable toward and away from the cylinder end past the side port and completely blocking the side port when advanced to the cylinder end; and means for operating the pump and thereby displacing material from the chute back in the pump tube.

2. The tunneling apparatus defined in claim 1, further comprising means for admitting a conveyor fluid into the pump under pressure, whereby the conveyor fluid pushes the material back in the tube.

3. The tunneling apparatus defined in claim 1 wherein the digging tool is a toothed wheel.

4. The tunneling apparatus defined in claim 1 wherein the means for pressurizing introduces a fluid into the chamber.

* * * * *